US006193116B1

(12) United States Patent
Sheffler et al.

(10) Patent No.: US 6,193,116 B1
(45) Date of Patent: Feb. 27, 2001

(54) SIFTER CAP FOR CONTINUOUS THREAD CONTAINERS

(75) Inventors: Robert J. Sheffler, Morganville; Thomas J. Dolan, Flemington, both of NJ (US)

(73) Assignee: Brent River Packaging Corporation, Flemington, NJ (US)

( * ) Notice: Subject to any disclaimer, the term of this patent is extended or adjusted under 35 U.S.C. 154(b) by 0 days.

(21) Appl. No.: 09/246,361

(22) Filed: Feb. 8, 1999

(51) Int. Cl.[7] ..... B65D 47/00
(52) U.S. Cl. ..... 222/480; 222/548; 222/565
(58) Field of Search ..... 222/480, 565, 222/548, 554, 256

(56) References Cited

U.S. PATENT DOCUMENTS 5,383,582 * 1/1995 Baxter et al. ..... 222/480
5,494,200 * 2/1996 Sheffler et al. ..... 222/565
5,507,419 * 4/1996 Martin et al. ..... 222/548
5,601,213 * 2/1997 Daniello ..... 222/480
5,730,322 * 3/1998 Iba et al. ..... 222/548
5,901,902 * 5/1999 Grabher ..... 222/480

* cited by examiner

*Primary Examiner*—Kevin Shaver
*Assistant Examiner*—Eric Keasel
(74) *Attorney, Agent, or Firm*—John H. Crozier

(57) ABSTRACT

A sifter cap for continuous thread containers of the type adapted to dispense a granular product. There is provided a screw cap adapted for securement to the container, and a sifter member disposed atop the screw cap and adapted for rotation with respect thereto. The screw cap has an annular, upwardly-facing bearing shoulder, and the sifter member has at least three downwardly-faced bearing nibs which slidably engage the bearing shoulder of the screw cap at relatively small areas of contact. The arrangement is such that the the sliding engagement between the screw cap and sifter member is characterized by reduced friction. In addition, in the event that granular product from the container strays onto the bearing shoulder of the screw cap, little resistance against rotation is encountered. As a consequence, there is thus enabled relatively smooth turning of the sifter member on the screw cap.

13 Claims, 2 Drawing Sheets

SIFTER CAP FOR CONTINUOUS THREAD CONTAINERS

NO CROSS REFERENCES TO RELATED APPLICATIONS

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates generally to dispensers for granular material, such dispensers having closure caps adapted to impart a sift characteristic, or alternately a pour characteristic, to the material being dispensed.

2. Description of the Related Art Including Information Disclosed Under 37 CFR §§1.97–1.99

The following references are considered to be a representative sampling of patents in the field to which the present invention pertains:

U.S. Pat. Nos.:

| | | |
|---|---|---|
| 2,449,285 | 2,961,132 | 4,548,331 |
| 4,653,672 | 4,699,299 | 5,123,574 |
| 5,269,432 | 5,383,582 | 5,507,419 |
| 5,601,213 | | |

U.S. Pat. No. 5,601,213 discloses a dispenser adapted for use with granulated material, such as spices. The dispenser has a rotatable overcap including detents in the form of nibs on its underside, which are received in depressions on a base cap. By such an arrangement, the overcap can be turnably held in various adjusted positions, giving rise respectively to different discharge characteristics.

U.S. Pat. No. 2,449,285 discloses a sifter construction wherein there is provided a turn cap comprising an inverted cup, the latter having an inturned curl (19) which underlies a retention bead on a base cap. The turn cap can be set to effect alignment or mis-alignment of cooperable discharge passages in the two cap parts.

U.S. Pat. No. 4,653,672 illustrates a twist cap construction wherein the turnable component is provided with a depending skirt that rides on a track in the base cap. The retention of the turnable component is accomplished by a plastic "rivet" (5), and there are stops in the cap construction, to confine the turning interval to predetermined limits, as indicated in FIG. 2.

U.S. Pat. No. 4,548,331 shows a closure construction for granular material. The disclosed device (FIG. 8) shows the use of multiple detents 50 on a base portion of the closure construction. Means are provided to retain the overcap portion in various adjusted positions, corresponding to different discharge rates of the granular material being dispensed.

U.S. Pat. Nos. 4,699,299 and 5,507,419 illustrate turnable cap constructions of a type incorporating interlocking peripheral beads on a base cap and a closure cap, respectively.

U.S. Pat. Nos. 2,961,132 and 5,383,582 disclose cap constructions wherein a turnable member is disposed inside an upwardly facing cup portion of a base cap. The remaining two references, U.S. Pat. Nos. 5,123,574 and 5,269,432, also relate to dispenser caps that are held captive on a base cap, and where provision is made for controlled discharge of the container contents. No. '574 utilizes what is known in the trade as a metering type closure, wherein a single unit dose or quantity can be dispensed, which is considered desirable for some applications.

It appears, however, that few if any, of the constructions noted above have been commercialized. This may be due to lack of marketing, or as a consequence of difficulty in manufacturing relative complex components in some cases, which represented an obstacle that may have thwarted the patentee in his attempts to successfully make and sell the respective inventions.

SUMMARY OF THE INVENTION

Accordingly, the above disadvantages and drawbacks of prior sifter-type cap constructions are largely overcome by the present invention, which has for an object the provision of a novel and improved sifter cap which is especially simple in its structure, comprising basically two separate molded plastic components.

Yet another object of the invention is to provide an improved sifter cap in accordance with the foregoing, which is resistant to malfunction due to inadvertent product build up between the movable parts.

A still further object of the invention is to provide an improved sifter cap of the typed noted above, wherein the components can be readily assembled without special tools, and with the use of automated assembly equipment.

Another object of the invention is to provide an improved sifter cap as above described, wherein the completed assembly is user-friendly, constituting a distinct advantage from the stand-point of successful marketing of the product.

The above objects are accomplished by a sifter cap for continuous thread containers of the type adapted to dispense a granular product, comprising in combination a screw cap adapted for securement to a container of the type indicated, the cap having an annular, upwardly-facing bearing shoulder, and a sifter member disposed atop the screw cap and adapted for rotation with respect thereto. The sifter member has at least three downwardly-faced bearing nibs which slidably engage the bearing shoulder of the screw cap at relatively small areas of contact, to thereby limit their engagement with the bearing shoulder per se, and also with any granular product which might inadvertently be carried onto the bearing shoulder.

The arrangement is such that an unusually smooth, rotation of the sifter cap is achievable, even in the presence of stray granular product which may accumulate over time.

Additionally, the simplest possible construction is utilized, namely two components in the preferred embodiment, thereby effectively keeping product cost to an absolute minimum.

Other features and advantages will hereinafter appear.

DESCRIPTION OF THE PREFERRED EMBODIMENT

Figure 5:
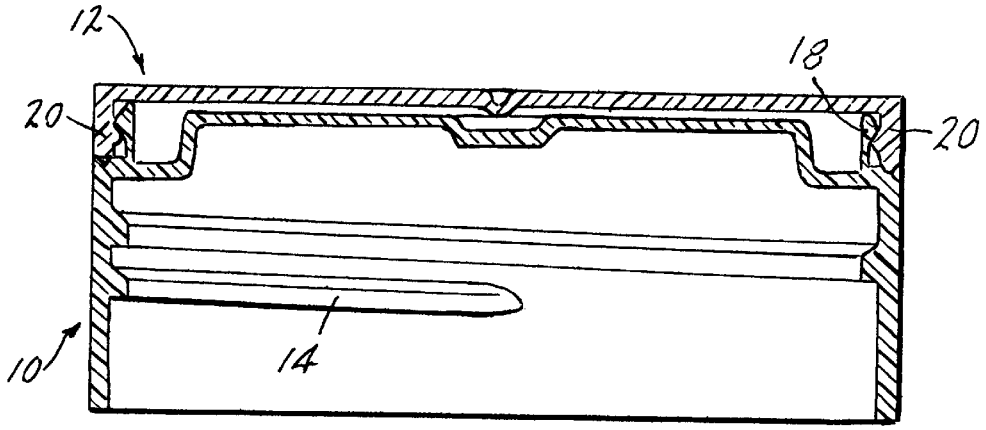
FIG. 5 is a diametric sectional view, enlarged, of the assembled sifter member and screw cap component.

Referring first to FIG. 5, the improved sifter cap of the invention comprises a continuous-thread type body component 10 generally referred to herein as a screw cap, on which there is rotatably carried a sifter member 12 which can have dispensing openings of various types, to be described later.

Figure 3:
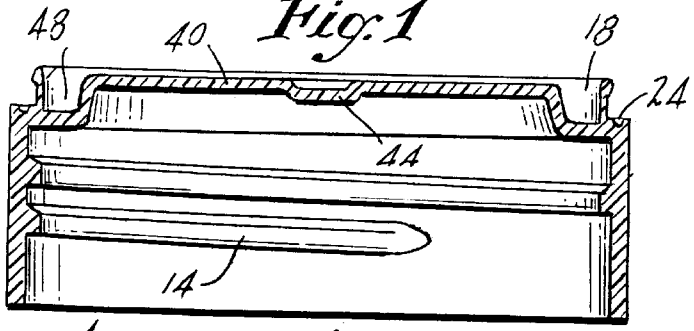
FIG. 3 is an enlarged diametric sectional view of the screw cap portion, taken on the line 3—3 of FIG. 1.

As seen in FIG. 3, the screw cap 10 has the usual continuous internal thread 14 by which it can be affixed to a threaded-neck container (not shown) in the conventional manner.

Figure 6:
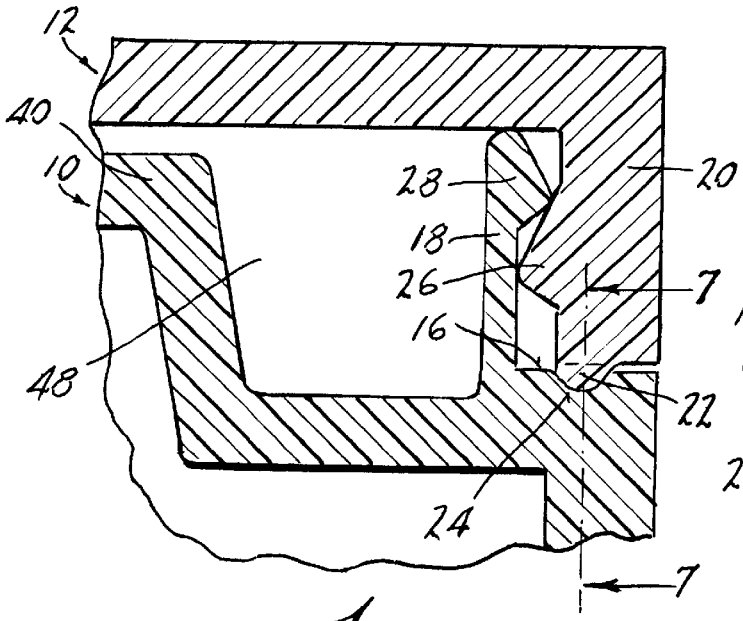
FIG. 6 is a greatly enlarged fragmentary sectional view of the upper right portion of FIG. 5.
Figure 7:
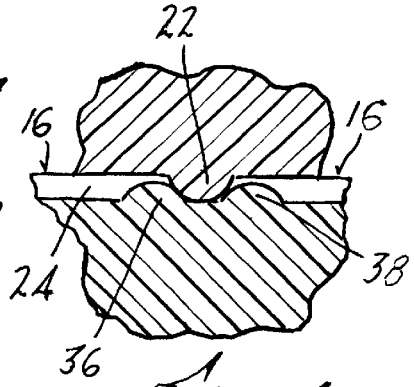
FIG. 7 is a sectional detail, taken on the line 7—7 of FIG. 6.

By the present invention, the cap body 10 is provided with a unique exterior annular shoulder means or track 16, FIGS. 6 and 7, that surrounds an upstanding barrier annulus 18. The track 16 constitutes part of a rotary stabilizing bearing for the sifter member 12, as will be later brought out.

Figure 2:
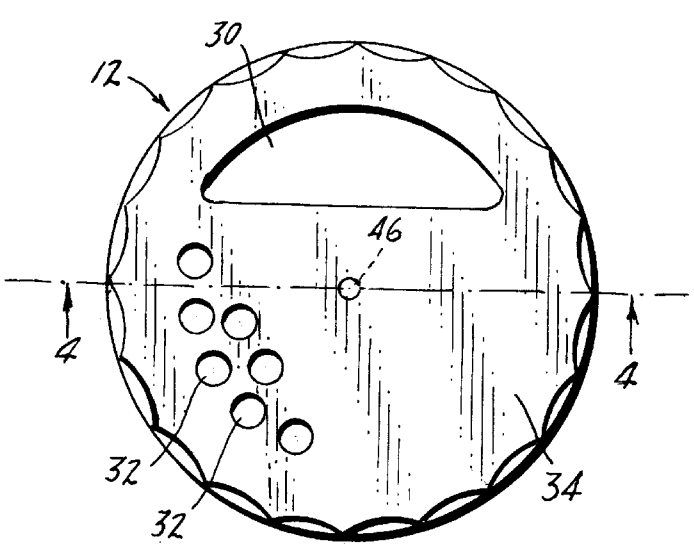
FIG. 2 is a top plan view of the sifter member of the sifter cap of the invention.
Figure 4:
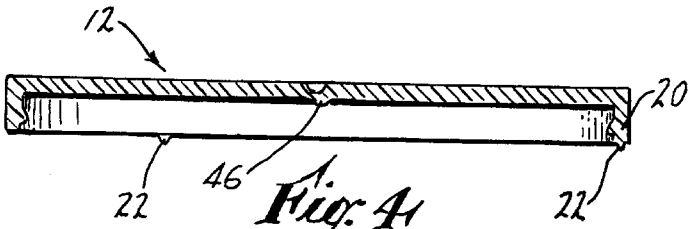
FIG. 4 is a further enlarged diametric sectional view of the sifter member of the sifter cap, taken on the line 4—4 of FIG. 2.

Referring to FIGS. 4 and 6, the sifter member 12 is provided with a depending peripheral flange 20 that can bear on the track 16 and ride thereon. As provided by the invention, however, the flange 20 has a plurality (three or more) of bearing nibs 22 in its under edge, and the shoulder 16 has a cooperable groove 24 to accommodate the nibs 22 during such travel.

Figure 1:
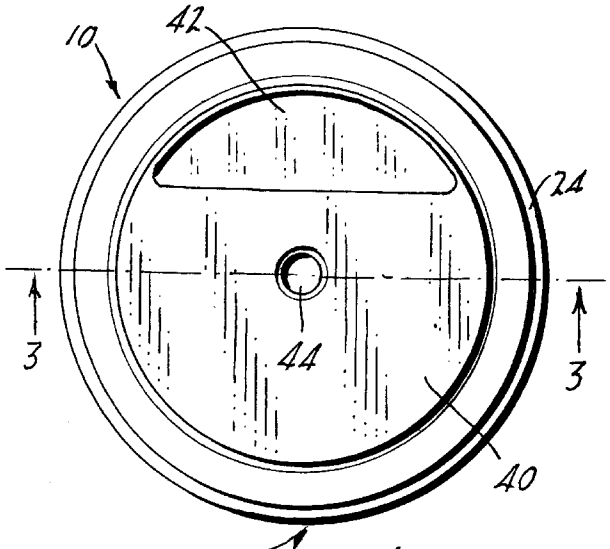
FIG. 1 is a top plan view of the screw cap portion or component of the sifter cap of the invention.

By such arrangement, a smoother and less encumbered turning of the sifter member 12 is had, even if the track or groove 24 should accumulate granular product that may have spilled or otherwise strayed from the intended discharge route through the sifter 12. Due to the small size of the groove or track 24 it is not clearly depicted as to its outlines in FIG. 1; however, it is clearly shown in the enlargements of FIGS. 3, 6 and 7. The provision of the barrier annulus 18 is effective in minimizing the likelihood of such granules being present in the track or groove 24, and thus serves an important function in the present invention.

The annular barrier 18 also serves as a rotary bearing surface, for engagement with the sifter member, as shown in the figures. Referring to FIG. 6, for example, the depending flange 20 of the sifter member surrounds and engages the barrier 18 with a detent action, to not only provide a rotary bearing but also a snap-fit detent to prevent separation of the sifter member from the screw cap.

For this purpose, the flange 20 has a truncated-section annular bead 26 which can be forced past a cooperable truncated-section annular bead 28 on the exterior of the barrier 18, FIG. 6.

The sifter member 12 can have a large, sector-shaped discharge passage 30 and also a plurality of small discharge openings 32, as well as a solid portion 34 to provide a variety of different discharge options, or else complete shut-off.

The invention provides a tactual means to aid in the selection of the type of discharge passage. Such means comprises sets of spaced-apart projections 36, 38 which are adapted for disposition on opposite sides of any bearing nib 22, so as to straddle the same. The user, in turning the sifter member 12, can feel the impediment provided by the projections 36, 38 and thereby determine the proper positioning of the sifter member, for the desired type of dispensing.

Also, the screw cap 10 is provided with a central raised portion or plateau 40 which has a segmental-shaped punch-out part 42 that normally retains the container in sealed, closed condition, as is usual. At its center, the plateau 40 has a depressed portion which under some circumstances can fill with product from the container, such product being engaged by a nib 46 of the sifter member to space these components apart a slight distance, for facilitating the operation of the sifter cap. Between the plateau and the barrier 18 there is an annular groove 48 of substantial cross section, which can serve to catch stray granular product from the container and prevent the same from constituting an impediment to the smooth turning operation of the sifter member. Such spacing can facilitate the spreading of product over the surface of the plateau in the event of product build up in this area, and reduce possible frictional drag and binding.

From the above it can be seen that there has been provided a novel and improved sifter cap which is both simple in its structure, reliable in operation, and easy to use. Additionally, the components are capable of fabrication in simple mold cavities, and thereafter readily assembled, whereby the overall manufacturing cost is held to an absolute minimum.

The disclosed device is thus seen to constitute a distinct advance and improvement in the hand-held dispenser art.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A combination screw and sifter cap device for continuous thread containers of the type adapted to dispense a granular product, comprising in combination:

a) a screw cap member adapted for securement to a container of the type indicated, said screw cap member having an annular, upwardly-facing bearing shoulder, said bearing shoulder comprising a substantially continuous upwardly facing trough on the periphery of said screw cap member, b) a sifter member disposed atop said screw cap member and adapted for rotation with respect thereto, and c) said sifter member having at least three downwardly-faced positioning and bearing nibs which slidably engage the surface of said upwardly facing trough at relatively small areas of contact to thereby limit their engagement with any granular product from the container which may be carried into the trough of the screw cap member.

2. A combination screw and sifter cap device as set forth in claim 1, wherein the sifter member has a depending annular flange, which mounts the bearing nibs.

3. A combination screw and sifter cap device as set forth in claim 1, wherein the trough of the screw cap member has detent means which are cooperable with the nibs of the sifter member to provide a tactile indication of the rotary position of the sifter member with respect to the screw cap member.

4. A combination screw and sifter cap device as set forth in claim 1, wherein:

a) the screw cap member has a barrier annulus that is within and parallel to the annular, upwardly-facing trough of the screw cap member to ward off granular product from the container that might possibly drift toward said trough, b) said sifter member having a depending annular flange which mounts the bearing nibs, and c) said barrier annulus and depending annular flange having means including cooperable, engagable surfaces to provide a rotary bearing for the sifter member.

5. A combination screw and sifter cap device as set forth in claim 4, wherein said cooperable engageable surfaces have cooperable detent means for holding the sifter member captive on the screw cap member.

6. A combination screw and sifter cap device as set forth in claim 1, wherein the screw cap member has a barrier annulus that is within and parallel to the annular, upwardly-facing trough of the screw cap member, to ward off granular product from the container that might possible drift toward said trough.

7. A combination screw and sifter cap device as set forth in claim 6, wherein the screw cap member has a raised plateau with which the barrier annulus thereof forms an annular product-trapping groove that is covered by the outer peripheral portion of the sifter member.

8. A combination screw and sifter cap device as set forth in claim 6, wherein the sifter has dispensing openings that are surrounded by said barrier annulus.

9. A combination screw and sifter cap device as set forth in claim 8, wherein the screw cap member has an annular product-entrapping groove disposed between said dispensing openings and barrier annulus.

10. A combination screw and sifter cap device as set forth in claim 6, wherein the screw cap member has a central raised plateau which is disposed closely to but spaced from the sifter member.

11. A combination screw and sifter cap device as set forth in claim 10, wherein the plateau of the screw cap member has a depressed portion at its center and one of the sifter member bearing nibs is cooperable with said depressed portion to maintain a space between said screw cap member and sifter member.

12. A combination screw and sifter cap device as set forth in claim 10, wherein the plateau of the screw cap member has a sector-shaped dispensing opening which spans a large fractional part of the perimeter of the plateau.

13. A combination screw and sifter cap device as set forth in claim 12, wherein the sifter member has a sector-shaped dispensing opening having a size and shape similar to the sector-shaped dispensing opening of the plateau of the screw cap member.

* * * * *